US007311143B2

(12) United States Patent
Engels et al.

(10) Patent No.: US 7,311,143 B2
(45) **Date of Patent: *Dec. 25, 2007**

(54) METHOD AND APPARATUS FOR GENERATION OF ACOUSTIC SHEAR WAVES THROUGH CASING USING PHYSICAL COUPLING OF VIBRATING MAGNETS

(75) Inventors: Ole Engels, Houston, TX (US); Joseph G. Barolak, Spring, TX (US); Douglas J. Patterson, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 284 days.

This patent is subject to a terminal disclaimer.

(21) Appl. No.: 10/971,485

(22) Filed: Oct. 22, 2004

(65) Prior Publication Data

US 2005/0205268 A1 Sep. 22, 2005

Related U.S. Application Data

(63) Continuation-in-part of application No. 10/802,612, filed on Mar. 17, 2004.

(51) Int. Cl.
*E21B 47/16* (2006.01)

(52) U.S. Cl. ..... 166/254.2; 166/66.5

(58) Field of Classification Search ..... 166/253.1, 166/254.2, 66.5

See application file for complete search history.

(56) References Cited

U.S. PATENT DOCUMENTS

| | | | | |
|---|---|---|---|---|
| 3,191,144 | A * | 6/1965 | Pardue | 367/25 |
| 3,724,589 | A * | 4/1973 | Chapman, III. | 367/30 |
| 5,047,992 | A | 9/1991 | Howlett | 367/31 |
| 5,229,554 | A | 7/1993 | Cole | 181/106 |
| 6,179,084 | B1 | 1/2001 | Yamamoto et al. | 181/106 |

* cited by examiner

*Primary Examiner*—William P Neuder
(74) *Attorney, Agent, or Firm*—Madan, Mossman & Sriram, P.C.

(57) ABSTRACT

The method and apparatus of the present invention provides for inducing and measuring shear waves within a wellbore casing to facilitate analysis of wellbore casing, cement and formation bonding. An acoustic transducer is provided that is magnetically coupled to the wellbore casing and is comprised of a magnet combined with a coil, where the coil is attached to an electrical current. The acoustic transducer is capable of producing and receiving various waveforms, including compressional waves, shear waves, Rayleigh waves, and Lamb waves as the tool traverses portions of the wellbore casing.

23 Claims, 9 Drawing Sheets

METHOD AND APPARATUS FOR GENERATION OF ACOUSTIC SHEAR WAVES THROUGH CASING USING PHYSICAL COUPLING OF VIBRATING MAGNETS

CROSS REFERENCE TO RELATED APPLICATIONS

This patent application is a continuation in part of U.S. patent application Ser. No. 10/802,612 filed on Mar. 17, 2004 entitled "Use of Electromagnetic Acoustic Transducers in Downhole Cement Evaluation" by Alexei Bolshakov, Vladimir Dubinsky, Douglas Patterson and Joseph Gregory Barolak.

FIELD OF THE INVENTION

The invention relates generally to the field of the evaluation of wellbore casing. More specifically the present invention relates to a method and apparatus to provide for the analysis of the bond securing casing within a wellbore environment by producing and recording characteristics of waveforms traversing casing and cement.

BACKGROUND OF THE INVENTION

As illustrated in FIG. 1 wellbores typically comprise casing 8 set within the wellbore 5, where the casing 8 is bonded to the wellbore by adding cement 9 within the annulus formed between the outer diameter of the casing 8 and the inner diameter of the wellbore 5. The cement bond not only adheres to the casing 8 within the wellbore 5, but also serves to isolate adjacent zones (e.g. $Z_1$ and $Z_2$) within an earth formation 18. Isolating adjacent zones can be important when one of the zones contains oil or gas and the other zone includes a non-hydrocarbon fluid such as water. Should the cement 9 surrounding the casing 8 be defective and fail to provide isolation of the adjacent zones, water or other undesirable fluid can migrate into the hydrocarbon producing zone thus diluting or contaminating the hydrocarbons within the producing zone, and increasing production costs, delaying production or inhibiting resource recovery.

To detect possible defective cement bonds, downhole tools 14 have been developed for analyzing the integrity of the cement 9 bonding the casing 8 to the wellbore 5. These downhole tools 14 are lowered into the wellbore 5 by wireline 10 in combination with a pulley 12 and typically include transducers 16 disposed on their outer surface formed to be acoustically coupled to the fluid in the borehole. These transducers 16 are generally capable of emitting acoustic waves into the casing 8 and recording the amplitude of the acoustic waves as they travel, or propagate, across the casing 8. Characteristics of the cement bond, such as its efficacy, integrity and adherence to the casing, can be determined by analyzing characteristics of the acoustic wave such as attenuation. Typically the transducers 16 are piezoelectric devices having a piezoelectric crystal that converts electrical energy into mechanical vibrations or oscillations transmitting acoustic wave to the casing 8. Piezoelectric devices typically couple to a casing 8 through a coupling medium found in the wellbore. Coupling mediums include liquids that are typically found in wellbores. When coupling mediums are present between the piezoelectric device and the casing 8, they can communicate the mechanical vibrations from the piezoelectric device to the casing 8. However, lower density fluids such as gas or air and high viscosity fluids such as some drilling mud may not provide adequate coupling between a piezoelectric device and the casing 8. Furthermore, the presence of sludge, scale, or other like matter on the inner circumference of the casing 8 can detrimentally affect the efficacy of a bond log acquired with a piezoelectric device. Thus for piezoelectric devices to provide meaningful bond log results, they must cleanly contact the inner surface of the casing 8 or be employed in wellbores, or wellbore zones, having liquid within the casing 8. Another drawback faced when employing piezoelectric devices for use in bond logging operations involves the limitation of variant waveforms produced by these devices. Fluids required to couple the wave from the transducer to the casing only conduct compressional waves, thus limiting the wave types that can be induced in or received from the casing. A great deal of information is derivable from variant acoustical waveforms that could be used in evaluating casing, casing bonds, and possibly even conditions in the formation 18. Therefore, there exists a need to conduct bond logging operations without the presence of a particular couplant. A need exists for a bond logging device capable of emitting and propagating into wellbore casing numerous types of waveforms, and recording the waveforms.

SUMMARY OF THE INVENTION

The method and apparatus of the present invention provides for inducing and measuring acoustic waves, including shear waves, within a wellbore casing to facilitate analysis of wellbore casing, cement and formation bonding. An acoustic transducer is provided that is magnetically coupled to the wellbore casing and is comprised of a magnet combined with a coil, where the coil is attached to an electrical current. The acoustic transducer is capable of producing and receiving various waveforms, including compressional waves, shear waves, Rayleigh waves, and Lamb waves. The transducer remains coupled to the wellbore casing as the tool traverses portions of the casing.

A downhole tool is provided for measuring acoustic waves traversing a wellbore casing. The transducers may remain coupled to the wellbore casing as the tool traverses sections of the wellbore. The transducer comprising a magnet and a coil mounted on the tool for generating acoustic vibrations into the wellbore casing and detecting the emitted signal. The transducer magnetically couples to said casing. The coil may be disposed between the magnet and the wellbore casing. The downhole tool may also comprise a microprocessor for processing the detected signals.

BRIEF DESCRIPTION OF THE FIGURES

The present invention and its advantages will be better understood by referring to the following detailed description and the attached drawings in which.

Figure 1:
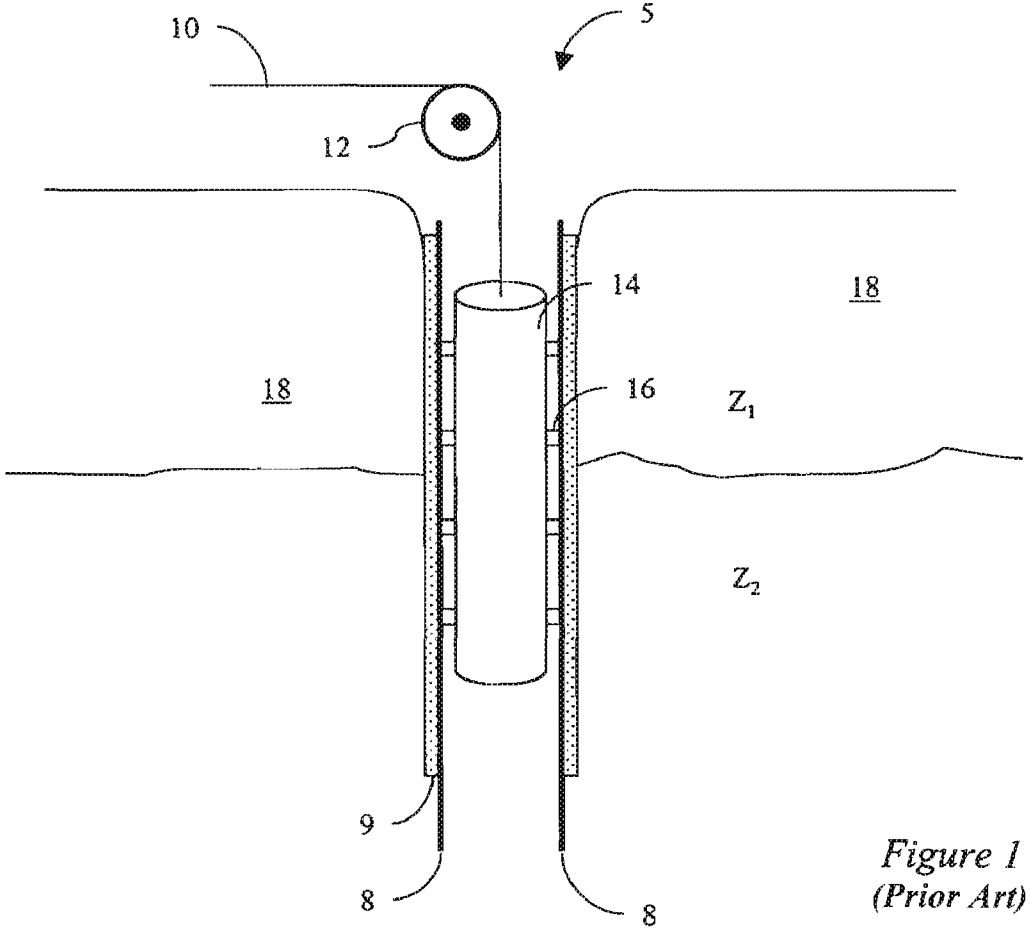
Figure 1 (Prior Art)
FIG. 1 depicts a partial cross section of prior art downhole cement bond log tool disposed within a wellbore.

While the invention will be described in connection with its preferred embodiments, it will be understood that the invention is not limited thereto. It is intended to cover all alternatives, modifications, and equivalents which may be included within the spirit and scope of the invention, as defined by the appended claims.

DETAILED DESCRIPTION OF THE INVENTION

The present invention comprises a downhole tool disposable within a wellbore comprising a magnetically coupling transducer, a transmitter and/or receiver comprising a coil and a magnet. The term "magnet" as used in reference to the present invention is used in its commonly-understood manner to mean any device that creates a magnetic field or that produces a magnetic field external to itself. A magnet may be a permanent magnet, a direct current electromagnet, an alternating current electromagnet, or any other device creating a magnetic field. The coil and the magnet are combinable to produce an energy field capable of inducing or measuring waveforms within the wellbore casing. Optionally, the magnetic coupling transducer is an electromagnetic acoustic transducer. The magnetic coupling transmitter and the receiver can be disposed onto the downhole tool housing and the transmitter disposed onto the wellbore casing. The tool comprises a receiver capable of sensing the waveforms within the wellbore casing. The downhole tool can further comprise a sonde formed to house the magnetic coupling transducer, a transmitter and receiver; the tool can be insertable within the wellbore casing. Optionally included with the tool is an electrical source capable of providing an electrical current to the coil, which may be activated electrically and/or electrically modulated. The downhole tool may traverse substantially the entire cased portion of a wellbore, or only a portion of the cased wellbore, with the transducer in contact and magnetically coupled to the wellbore casing.

The magnetic coupling transmitter/receiver is capable of forming or receiving a wave within the casing. Such a wave may include compressional waves, shear waves, transversely polarized shear waves, Lamb waves, Rayleigh waves, and combinations thereof. The magnetic coupling transmitter and the receiver can be disposed at substantially the same radial location with respect to the axis of the housing. Alternatively, the magnetic coupling transmitter and the receiver can be disposed at varying radial locations with respect to the axis of the housing. Alternatively the magnetic coupling transmitter and the receiver can be disposed at substantially the same location along the length of the housing. The magnetic coupling transmitter and the receiver can be disposed at different locations along the length of the housing. Two or more rows of acoustic devices can be disposed radially with respect to the axis of the housing, wherein the acoustic devices include at least one magnetic coupling transmitter and at least one receiver. Optionally, these rows can be staggered or can be substantially helically arranged. Alternatively, any magnet/coil pair may serve as both a transmitter and a receiver at different times during the data acquisition or measurement process.

The present invention provides a method of inspecting the casing bond of a casing disposed within a wellbore. The method can involve combining a magnetic field with an electrical field to induce waveforms within the casing where the waveforms pass through the wellbore casing; sensing the waveforms propagating through the wellbore casing; and analyzing the waveforms propagating through the wellbore casing to determine the integrity of the casing bond. The method of the present invention can further comprise forming the magnetic field and the electrical field with a magnetically coupled transducer and receiving the reflected waves with a receiver. The method can also include adding an electrical source to the coil.

Additionally, the magnetically coupled transducer of the present method can comprise a magnet and a coil, wherein the magnet is selected from the group comprising a permanent magnet, a direct current electromagnet, and an alternating current electro-magnet. Further, the magnetically coupled transducer can be comprised of one or more electromagnetic acoustic transducers. With regard to the present method, the waves induced by the combination of the magnetic field with the electrical field include those selected from the group comprising compressional waves, shear waves, Lamb waves, Rayleigh waves, and combinations thereof. Additionally, the present invention provides for a sonde disposed within the wellbore with a transducer magnetically coupled and in operative communication with the wellbore casing. The magnetically coupled transmitter and receiver can be disposed at substantially the same radial location with respect to the axis of the casing. Optionally, in the method of the present invention, the magnetically coupled transmitter and receiver can be disposed at varying radial locations with respect to the axis of the casing. Further, the magnetically coupled transmitter and receiver can be disposed at substantially the same location along the length of the casing or can be disposed at different locations along the length of the casing. The method can further include disposing two or more rows radially with respect to the axis of the casing, wherein each of the two or more rows includes at least one magnetic coupling transmitter and at least one receiver, each of the two or more rows can be staggered or can be helically arranged. Accordingly, one of the advantages provided by the present invention is the ability to conduct casing bond logging activities in casing irrespective of the type of fluid within the casing and irrespective of the conditions of the inner surface of the casing.

Additionally, the magnetically coupled transducer of the present method can comprise a magnet and a coil, wherein the magnet is one or more of a permanent magnet, a direct current electromagnet, and an alternating current electromagnet. Further, the magnetically coupled transducer can be an electromagnetic acoustic transducer. With regard to the present method, the waves induced by the combination of the magnetic field with the electrical field include compressional waves, shear waves, Lamb waves, Rayleigh waves, and combinations thereof. Additionally, the method of the present invention may comprise the magnetically coupled transducer with a receiver mounted to a sonde disposed within the casing, wherein the sonde is in operative communication with the surface. The magnetic coupling transmitter and the receiver can be disposed at substantially the same radial location with respect to the axis of the casing. Optionally, in the method of the present invention, the magnetic coupling transmitter and the receiver can be disposed at varying radial locations with respect to the axis of the casing. Further, the magnetically coupling transmitter and the receiver can be disposed at substantially the same location along the length of the casing or can be disposed at different locations along the length of the casing. The method can further include disposing two or more rows radially with respect to the axis of the casing, wherein each of the two or more rows includes at least one magnetic coupling transmitter and at least one receiver, each of the two or more rows can be staggered or can be helically arranged. Accordingly, one of the advantages provided by the present invention is the ability to conduct casing bond logging activities in casing irrespective of the type of fluid within the casing and irrespective of the conditions of the inner surface of the casing. An additional advantage of the present invention is the ability to induce and then detect numerous waveforms within the casing, combinations of waveforms within the casing, and simultaneous waveforms within the casing.

Figure 2A:
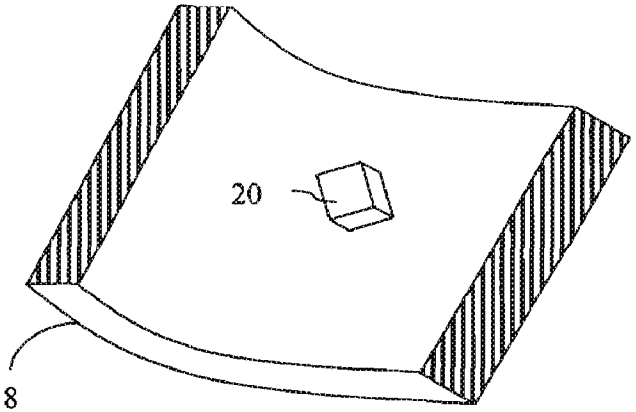
FIGS. 2A-2B schematically illustrate a magnetic coupling transmitter disposed to couple to a section of casing.

As illustrated in FIG. 2A, a magnetically coupled transducer 20 is positioned at any desired attitude proximate to a section of casing 8. For the purposes of clarity, only a portion of the length and diameter of a section of casing 8 is illustrated and the magnetically coupled transducer 20 is shown schematically in both FIG. 2A and FIG. 2B. The magnetically coupled transducer 20 may be positioned within the inner circumference of the tubular casing 8, but the magnetically coupled transducer 20 can also be positioned in other areas.

Figure 2B:
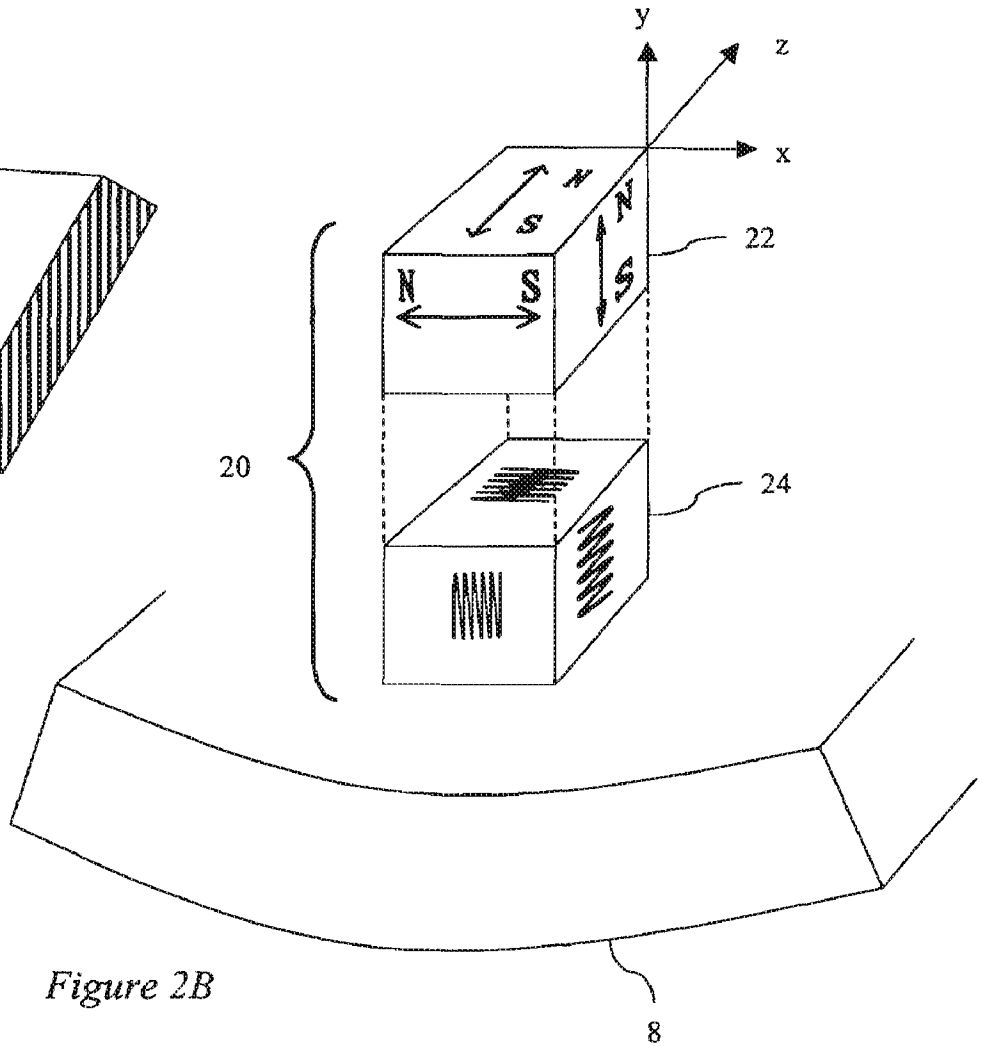

For any particular transducer 20, more than one magnet (of any type for example permanent, electro-magnetic, etc.) may be combined within a unit; such a configuration enables inducing various waveforms and facilitating measurement and acquisition of several waveforms. A transducer 20 capable of transmitting or receiving waveforms in orthogonal directions is schematically illustrated in FIG. 2B. While a schematic magnet 22 with orthogonal magnetic fields is illustrated, a single-field relatively large magnet with multiple smaller coils 24 (which coils may be disposed orthogonally) may be employed to form versatile transducers.

In embodiments provided by the present invention that are illustrated schematically in FIGS. 2A and 2B, the magnetically coupled transducer 20 is comprised of a magnet 22 and a coil 24, where the coil 24 is positioned between the magnet 22 and the inner circumference of the casing 8. An electrical current source (not shown) is connectable to the coil 24 capable of providing electrical current to the coil 24. The magnet 22, may be one or more permanent magnets in various orientations or can also be an electro-magnet, energized by either direct or alternating current. FIG. 2B schematically illustrates orthogonal magnetic and coil representations. One or more magnets or coils may be disposed within a downhole tool to affect desired coupling and/or desired wave forms such as the direct inducing of shear waves into casing 8. While the coil is illustrated as disposed between the magnet and the casing, the coil may be otherwise disposed adjacent to the magnet.

The coil 24 may be energized when the magnetically coupled transducer 20 is proximate to the casing 8 to produce acoustic waves within the material of the casing 8. For example the coil may be energized with a modulated electrical current. Thus the magnetically coupled transducer 20 operates as an acoustic transmitter.

The magnetically coupled transducer 20 can also operate as a receiver capable of receiving waves that traversed the casing and cement. The magnetically coupled transducer 20 may be referred to as an acoustic device. As such, the acoustic devices of the present invention function as acoustic transmitters or as acoustic receivers, or as both.

Figure 3:
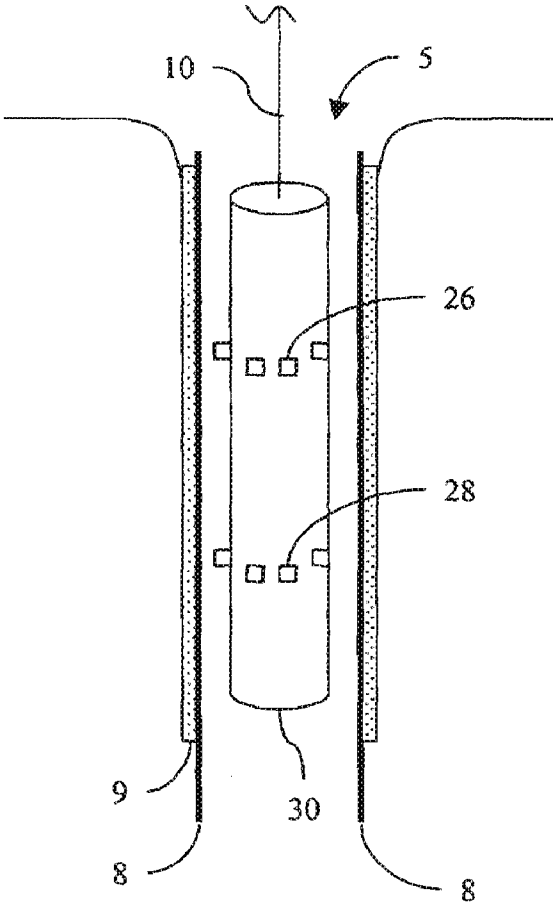
FIG. 3 shows one embodiment of the present invention disposed within a wellbore.

The present invention as illustrated in FIG. 3 provides a sonde 30 shown having acoustic devices disposed on its outer surface. The acoustic devices comprise a series of acoustic transducers, both transmitters 26 and receivers 28, where the distance between each adjacent acoustic device on the same row may be substantially the same. With regard to the configuration of acoustic transmitters 26 and acoustic receivers 28 shown in FIG. 3, while the rows 34 radially circumscribing the sonde 30 can comprise any number of acoustic devices (i.e. transmitters 26 or receivers 28), it is preferred that each row 34 comprise five or more of these acoustic devices (the preference for five or more devices is for devices with the transmitters and receivers radially arranged around the circumference e.g., FIG. 4*a*). The acoustic transmitters 26 may be magnetically coupled transducers 20 of the type of FIGS. 2A and 2B comprising a magnet 22 and a coil 24. Optionally, the acoustic transmitters 26 can comprise electromagnetic acoustic transducers.

Referring now again to the configuration of the acoustic transmitters 26 and acoustic receivers 28 of FIG. 3, the acoustic transducers comprising transmitters 26 and receivers 28 can be arranged in at least two rows where each row comprises primarily acoustic transmitters 26 and a next adjacent row comprises primarily acoustic receivers 28. Optionally, as shown in FIG. 3, the acoustic devices within adjacent rows in this arrangement are aligned in a straight line along the length of the sonde 30.

While only two circumferential rows 34 of acoustic devices are shown in FIG. 3, variations and placement of transducers and arrangements in rows can be included depending on the capacity and application of the sonde 30. Another arrangement is to have one row of acoustic transducers 26 followed by two circumferential rows of acoustic receivers 28 followed by another row of acoustic transducers 26. As is known in the art, advantages of this particular arrangement include the ability to make a self-correcting acoustic measurement. Attenuation measurements are made in two directions using arrangements of two transmitters and two receivers for acquisition of acoustic waveforms. The attenuation measurements may be combined to derive compensated values that do not depend on receiver sensitivities or transmitter power.

Figure 4D:
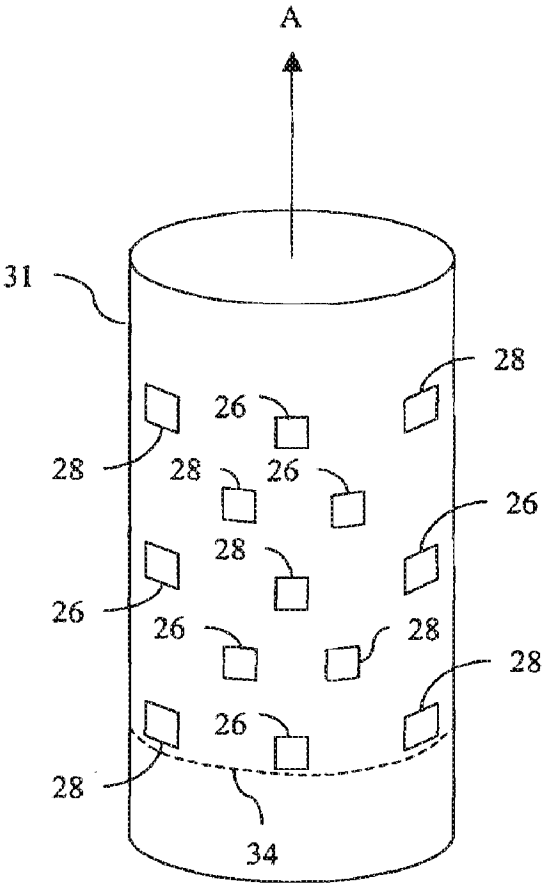
FIGS. 4A-4D depict alternative embodiments of the present invention.
Figure 4C:
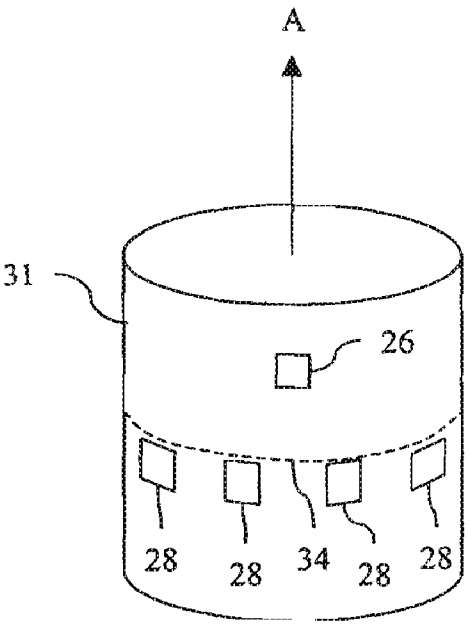
Figure 4B:
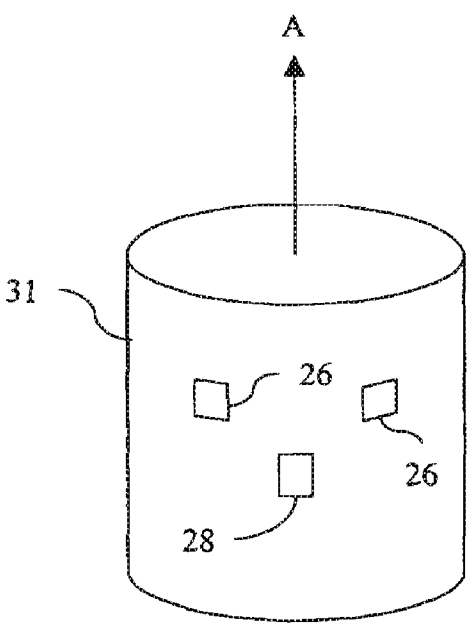
Figure 4A:
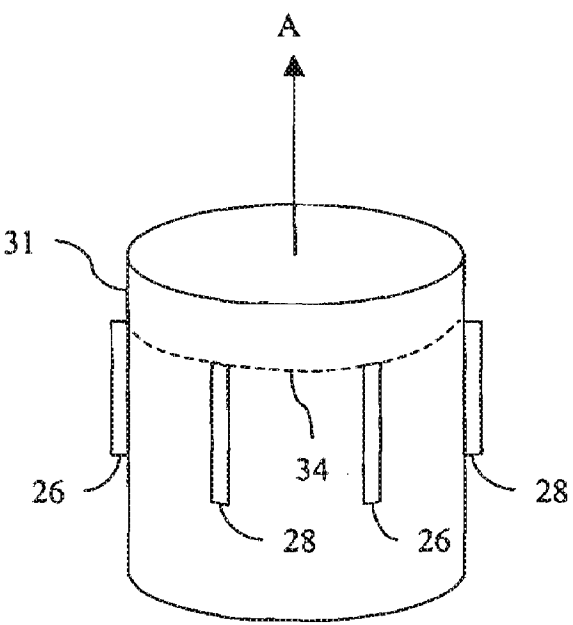

Additional arrangements of the acoustic transducers 26 and acoustic receivers 28 disposed on a sonde 31 are illustrated in a series of non-limiting examples in FIGS. 4A through 4D. In the embodiment of FIG. 4A a row of alternating acoustic transducers, transmitters 26 and receivers 28 are disposed around the sonde 31 at substantially the same elevation. The acoustic devices may be equidistantly disposed around the axis A of the sonde section 31. In an alternative configuration of the present invention shown in FIG. 4B, the acoustic devices are disposed in at least two rows around the axis A of the sonde section 31, but unlike the arrangement of the acoustic devices of FIG. 3, the acoustic devices of adjacent rows are not aligned along the length of the sonde 30, but instead are staggered.

FIG. 4C illustrates a configuration where a single acoustic transmitter 26 cooperates with a group or groups of acoustic receivers 28. Optionally the configuration of FIG. 4C can have from 6 to 8 receivers 28 for each transmitter 26. FIG. 4D depicts rows of acoustic transducers where each row comprises a series of alternating acoustic transducers 26 and acoustic receivers 28. The configuration of FIG. 4D is similar to the configuration of FIG. 4B in that the acoustic devices of adjacent rows are not aligned but instead are staggered. It should be noted however that the acoustic devices of FIG. 4D may be staggered in a way that a substantially helical pattern (44) is formed by acoustic devices around the sonde. The present invention is not limited in scope to the configurations displayed in FIGS. 4A through 4D, and other arrangements will occur to practitioners of the art and are contemplated within the scope of the present invention.

In operation of one embodiment of the present invention, a series of acoustic transmitters 26 and acoustic receivers 28 are included on a sonde 30 (or other downhole tool). The sonde 30 is then secured to a wireline 10 and deployed within a wellbore 5 for evaluation of the casing 8, casing bond, and/or formation 18. When the sonde 30 is within the casing 8 and proximate to the region of interest, the electrical current source can be activated thereby energizing the coil 24. Providing current to the coil 24 via the electrical current source produces eddy currents within the surface of the casing 8 as long as the coil 24 is sufficiently proximate to the wall of the casing 8. It is within the capabilities of those skilled in the art to situate the coil 24 sufficiently close to the casing 8 to provide for the production of eddy currents within the casing 8. Inducing eddy currents in the presence of a magnetic field imparts Lorentz forces onto the particles conducting the eddy currents that in turn causes oscillations within the casing 8 thereby producing waves within the wall of the casing 8. The coil 24 of the present invention can be of any shape, design, or configuration as long as the coil 24 is capable of producing an eddy current in the casing 8.

Accordingly, the magnetically coupled transducer 20 is magnetically "coupled" to the casing 8 by virtue of the magnetic field created by the magnetically coupled transducer 20 in combination with the eddy currents provided by the energized coil 24. Thus one of the many advantages of the present invention is the ability to provide coupling between an acoustic wave producing transducer without the requirement for the presence of liquid medium. Additionally, these magnetically induced acoustic waves are not hindered by the presence of dirt, sludge, scale, or other like foreign material as are traditional acoustic devices, such as piezoelectric devices.

The waves induced by combining the magnet 22 and energized coil 24 propagate through the casing 8. These acoustic waves can further travel from within the casing 8 through the cement 9 and into the surrounding formation 18. At least a portion of these waves can be reflected or refracted upon encountering a discontinuity of material, either within the casing 8 or the area surrounding the casing 8. Material discontinuities include the interface where the cement 9 is bonded to the casing 8 as well as where the cement 9 contacts the earth formation (e.g. $Z_1$ and $Z_2$ of FIG. 1). Other discontinuities can be casing seams or defects, or even damaged areas of the casing such as pitting or corrosion.

As is known, the waves that propagate through the casing 8 and the reflected waves are often attenuated with respect to the wave as originally produced. The acoustic wave characteristic most often analyzed for determining casing and cement adhesion is the attenuation of the transmitted waves that have traversed portions of the casing 8 and/or cement 9. Analysis of the amount of wave attenuation can provide an indication of the integrity of a casing bond (i.e. the efficacy of the cement 9), the casing thickness, and casing integrity. The reflected waves and the waves that propagate through the casing 8 can be recorded by receiving devices disposed within the wellbore 5 and/or on the sonde. The sonde 30 may contain memory for data storage and a processor for data processing. If the sonde 30 is in operative communication with the surface through the wireline 10, the recorded acoustic waves can be subsequently conveyed from the receivers to the surface for storage, analysis and study.

An additional advantage of the present design includes the flexibility of producing and recording more than one type of waveform. The use of variable waveforms can be advantageous since one type of waveform can provide information that another type of waveform does not contain. Thus the capability of producing multiple types of waveforms in a bond log analysis can in turn yield a broader range of bond log data as well as more precise bond log data. With regard to the present invention, not only can the design of the magnet 22 and the coil 24 be adjusted to produce various waveforms, but can also produce numerous wave polarizations.

Figure 5:
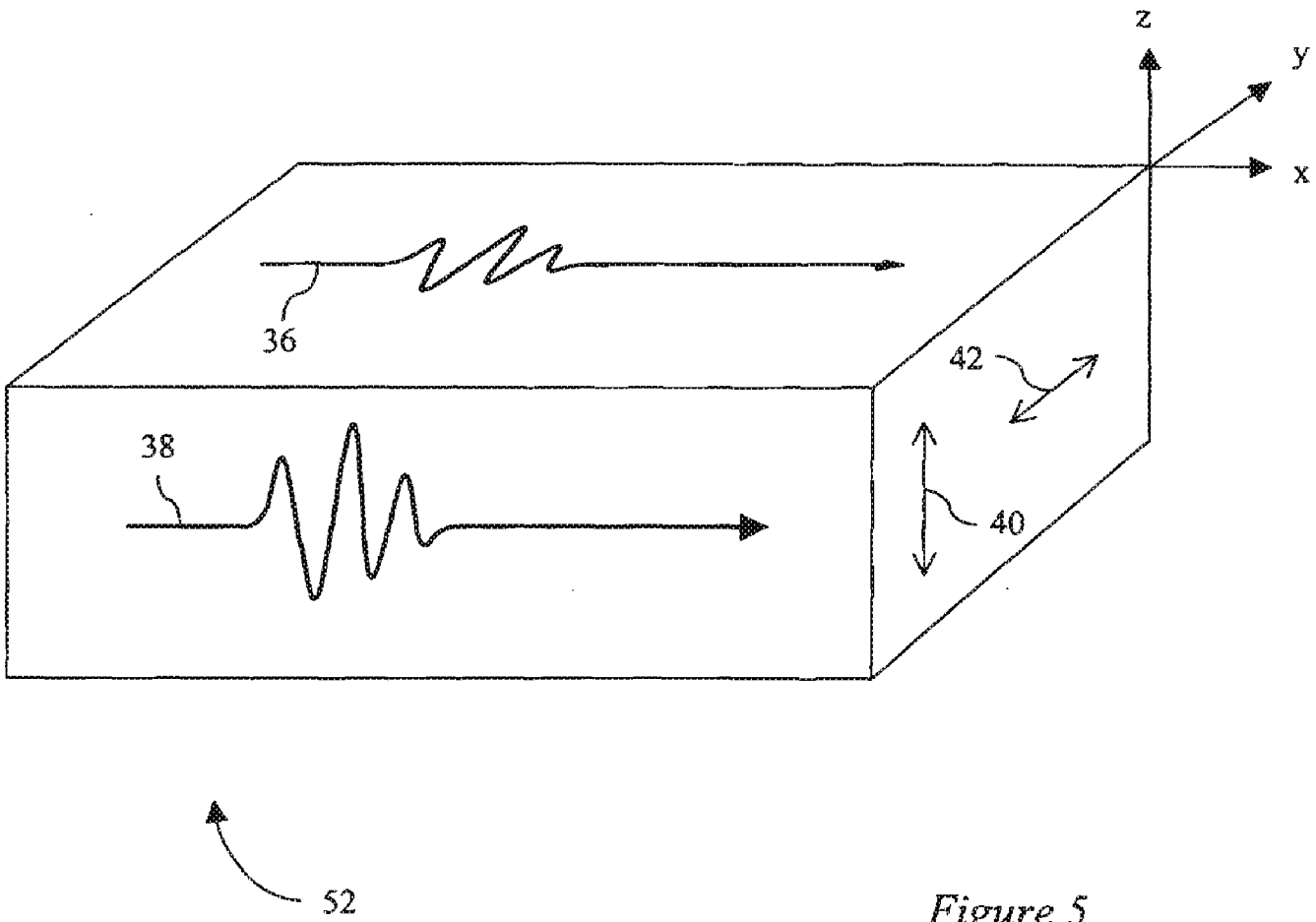
FIG. 5 illustrates shear waveforms propagating through a section of a medium.

FIG. 5 illustrates a vertical shear ($S_V$) waveform 38 and a horizontal shear ($S_H$) waveform 36 that are shown propagating in the x-direction within a wave medium 52. The z-direction has been arbitrarily chosen as up or vertical. The shear waveforms 38 and 36 comprise particle wave motion transverse to the direction of wave propagation. While both waves propagate in the x-direction, they are polarized in different directions. Polarization refers to the direction of particle movement within the medium 52 transverse to the direction of propagation of a wave. A transverse wave is a wave in which the vibrating elements (or particle motion of the medium 32) moves in a direction perpendicular to the direction of advance of the wave. The compressional polarization arrow 40 depicts the direction of polarization of the compressional waveform 38. From this it can be seen that polarization of $S_V$ waves 38 is substantially vertical, or in the z-direction. Conversely, with reference to the shear polarization arrow 42 for the ($S_H$) waveform 36, the direction of polarization is substantially in the y-direction, or normal (horizontally) to the direction of wave propagation.

The shapes and configurations of these waves are illustrated in FIG. 5 as examples of shear waveforms that can be produced by use of a magnetically coupled transducer 20. Moreover, the magnetically coupled transducers 20 are capable of producing additional waveforms, such as Lamb waves, Rayleigh waves. Additionally, the present invention provides for the production of multiple waveforms with the same acoustic transducer. A single transducer of the present invention may be used to produce compressional waves, shear waves, Rayleigh waves, Lamb waves, as well as combinations of these waveforms, and producing these waveforms directly in the casing 8. In contrast, prior art piezoelectric transducers are limited to the production of compressional waveforms into wellbore casing because only compressional waveforms will propagate through a fluid medium.

Figure 6A:
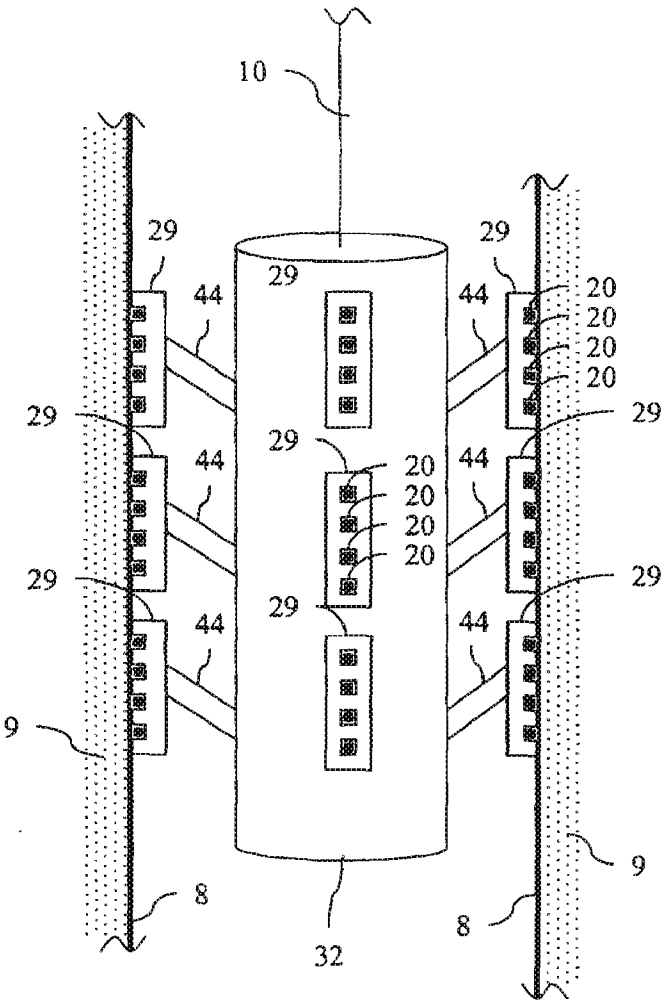
FIG. 6A illustrates an embodiment of the present invention where the transducers are dynamically positioned at or near the well casing inside surface.

FIG. 6A illustrates a bond log tool 32 provided by the present invention where the transducers 20, which may be in a housing or pad 29, are kept in contact with the wellbore casing in substantially all the casing circumference using offset arms 44. Typically high offset arm forces are required which hinder the tool from moving freely. The present invention provides efficient coupling as an electromagnet comprising a vibrating transmitter is dragged along the casing as the tool moves. By vibrating these electromagnets that are magnetically coupled to the casing, the casing physically oscillates. S-waves may be generated by the casing and traverse the cement-bond, cement 9, and underlying formation. The s-waves reflections and refractions may be received with conventional sensors.

FIG. 6A illustrates a pad 29 containing four transducers 20, but the number and positions of pads 29 is not limited to any specific arrangement. The pad 29 with four transducers 20 illustrated in FIG. 6A allows for the implementation of the compensated attenuation arrangement of two receivers between two transmitters, but this is not a limitation and other arrangements may be implemented.

Figure 6B:
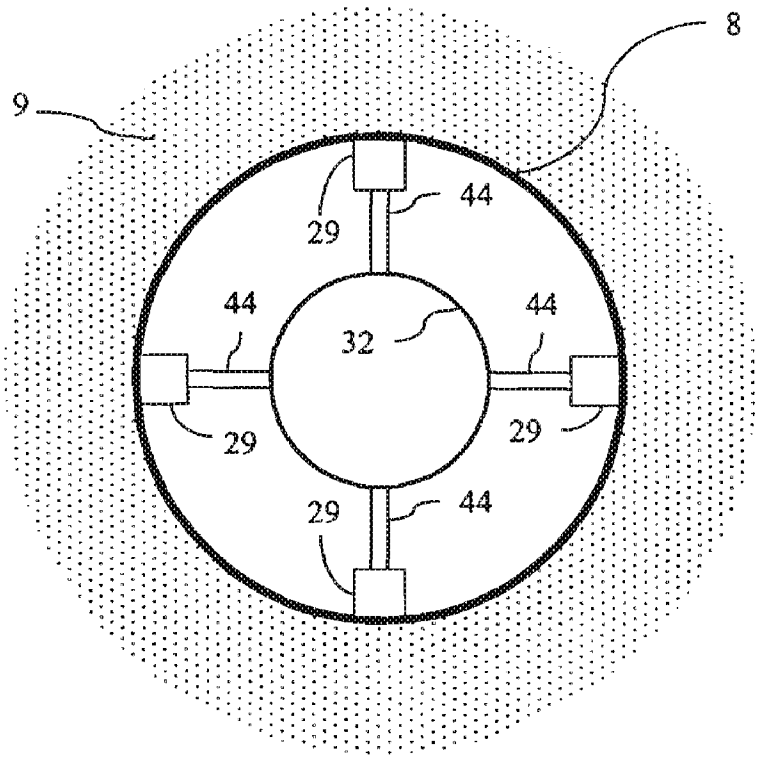
FIG. 6B illustrates a crossectional view of an embodiment of the present invention illustrated in FIG. 6A.
Figure 6C:
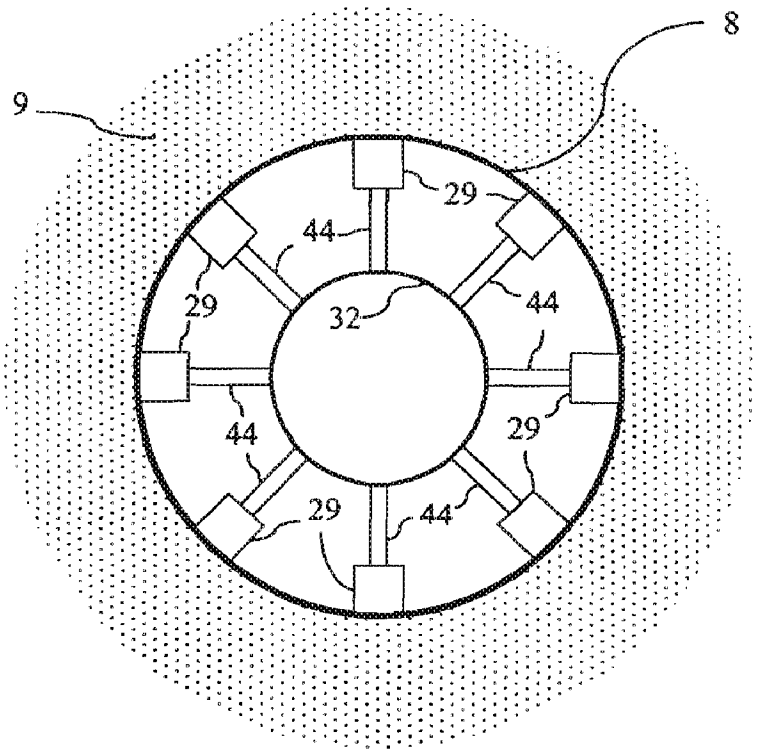
FIG. 6C illustrates a crossectional view of an embodiment of the present invention.

FIG. 6B illustrates a cross-sectional view of sonde 32 with offset arms 44 allowing for the magnetically coupling transducers, transmitters or receivers, to contact the casing 8 wall. While four pads 29 with transducers are illustrated in FIG. 6B, FIG. 6C illustrates a sonde providing eight pads that contact the casing 8. An arrangement of six pads with transducers has been found to provide good quantitative analysis of cement bond-to-casing in six 60° segments for 360° coverage around the borehole. Additionally, offset arms may be used to implement other transducer disposition arrangements radially and longitudinally, such as those illustrated in FIGS. 4A-4B.

The present invention offers significant operating advantages over prior art tools due to its insensitivity to heavy or gas-cut borehole fluids, fast formations, temperature and pressure variations, and moderate tool eccentering. The invention is essentially unaffected by various borehole fluids because the offset arms 44 of the tool pads 29 provide for transducers 20 that are coupled magnetically against the casing interior wall where actual measurements are acquired. This enables good results in heavy or gas-cut, mud-filled boreholes. The invention is not affected by "mud" arrivals and can be used effectively in large-diameter pipe and may log a well with a variety of casing sizes on a single pass.

The present invention is effective in environments with fast formations. Using shear waves with short pad spacing does not allow sufficient distance for fast-formation arrivals to overtake casing-borne arrivals.

The present invention further provides for a downhole instrument, which may be sonde 32 of FIG. 6A, which is controlled by an electronic cartridge (not shown) that comprises a downhole microprocessor, a telemetry system which may be digital, and the electronic cartridge may have data storage. Downhole data processing and digital telemetry eliminate distortions that can occur in analog signal transmission by the wireline. Any of the waveforms can be digitized downhole, optionally processed downhole and displayed at the surface.

Figure 7:
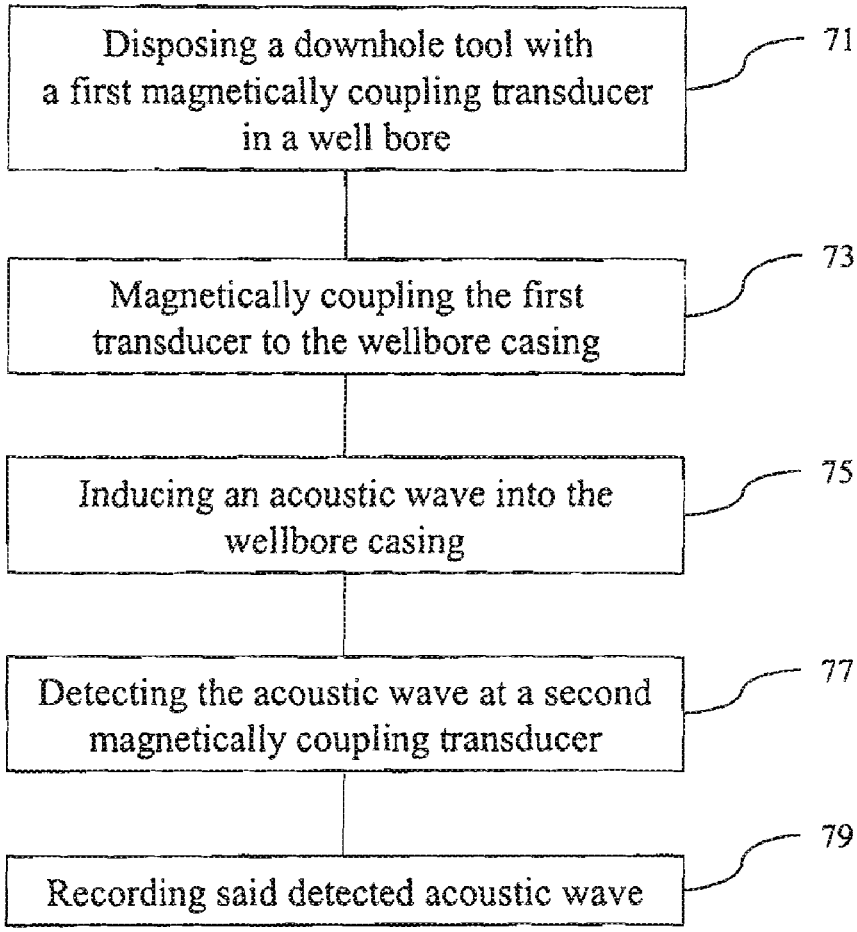
FIG. 7 is a flow chart illustrating a method provided by the present invention.

FIG. 7 is a flow chart illustrating a method provided by the present invention. A downhole tool, which may be a sonde, is disposed 71 into a wellbore. A magnetically coupling transducer is coupled 73 to the wellbore casing. The downhole tool may comprise extendable arms with pads holding a plurality of transducers for generating and receiving acoustic energy on the wellbore casing. The coupled transducer generates acoustic waves 75 into the wellbore casing. The generated acoustic waves are detected 77 at a second magnetically coupling transducer and the waves are recorded 79. The data recorded may be further processed and/or stored in the downhole tool or transmitted by telemetry to the surface for further processing, analysis and display.

The present invention described herein, therefore, is well adapted to carry out the objects and attain the ends and advantages mentioned, as well as others inherent therein. While various embodiments of the invention have been given for purposes of disclosure, numerous changes exist in the details of procedures for accomplishing the desired results. Various modifications will be apparent to those skilled in the art. It is intended that all variations within the scope and spirit of the appended claims be embraced by the foregoing disclosure.

What is claimed is:

1. A downhole tool for acquiring acoustic waves traversing a tubular comprising:

(a) a first transducer magnetically coupled directly to the tubular, the first transducer configured to generate acoustic vibrations into the tubular;

(b) a second transducer magnetically coupled directly to said tubular, the second transducer configured to receiver the acoustic vibrations; and (c) a pad formed to house at least one of (A) the first transducer, and (B) the second transducer.

2. The downhole tool of claim 1 wherein said pad is attached to an extendable offset arm.

3. The downhole tool of claim 1 wherein the first transducer further comprises a magnet, a coil disposed between said magnet and said tubular, an electrical source configured to provide an electrical current to said coil, wherein said magnet is selected from the group consisting of: (i) a permanent magnet, (ii) a direct current magnet, and (iii) an alternating current magnet.

4. The downhole tool of claim 1 wherein said first transducer is configured to induce a wave within the tubular, said wave selected from the group consisting of: i) a compressional wave, ii) a shear wave, iii) a Lamb wave, and iv) a Rayleigh wave.

5. The downhole tool of claim 1 further comprising a processor configured to process said received acoustic vibrations.

6. The downhole tool of claim 1 wherein the tubular comprises a wellbore casing.

7. The downhole tool of claim 1 wherein the operation of the tool is substantially insensitive to at least one of: (i) a presence of heavy fluids in the wellbore, (ii) a presence of gas-cut fluid in the wellbore, (iii) a formation having a higher shear velocity than a compressional velocity of a fluid in the wellbore, (iv) a change in temperature, (v) a change in pressure, and (vi) eccentering of the tool within the wellbore.

8. The downhole tool of claim 1 wherein said first transducer is configured to generate the vibrations using a Lorentz force.

9. A downhole tool for acquiring acoustic waves traversing a tubular, the tool comprising:

(a) a first transducter magnetically coupled directly to the tubular, the first transducer configured to generate acoustic vibrations into the tubular, wherein said first transducer is configured to generate vibrations into the tubular using Lorentz forces.

10. The downhole tool of claim 9 further comprising a second transducer magnetically coupled directly to said tubular, the second transducer configured to receive the acoustic vibrations.

11. The downhole tool of claim 9 wherein the first transducer further comprises a magnet, a coil disposed between said magnet and said tubular, an electrical source configured to provide an electrical current to said coil, wherein said magnet is selected from the group consisting of: (i) a permanent magnet, (ii) a direct current magnet, and (iii) an alternating current magnet.

12. The downhole tool of claim 9 wherein said first transducer is configured to induce a wave within the tubular, said wave selected from the group consisting of: i) a compressional wave, ii) a shear wave, iii) a Lamb wave, and iv) a Rayleigh wave.

13. A method of acquiring acoustic waves traversing a tubular with a downhole tool comprising:

(a) magnetically coupling a first transducer on the downhole tool directly to said tubular; and (b) inducing an acoustic wave into the tubular using said first transducer; wherein said first transducer comprises a coil disposed between a magnet and the tubular.

14. The method of claim 13 further comprising:

(i) detecting the acoustic wave at a second transducer on the downhole tool; and (ii) recording said detected acoustic wave.

15. The method of claim 14 further comprising magnetically coupling the second transducer directly to said tubular.

16. The method of claim 14 further comprising traversing a portion of the tubing with said second transducer magnetically coupled to the tubing.

17. The method of claim 14 further comprising using a processor on the downhole tool for processing said recorded signals.

18. The method of claim 14 further comprising analyzing the detected acoustic wave to provide an indication of at least one of: (i) a quality of a casing bond, (ii) a casing thickness, and (iii) casing integrity.

19. The method of claim 13 further comprising using an offset arm to facilitate coupling the first transducer to said tubular.

20. The method of claim 13 wherein said acoustic wave comprises a shear wave.

21. The method of claim 13 wherein the tubular comprises a wellbore casing.

22. The method of claim 21 wherein the detected acoustic wave is substantially insensitive to at least one of: (i) a presence of heavy fluids in the wellbore, (ii) a presence of gas-cut fluid in the wellbore, (iii) a formation having a higher shear velocity than a compressional velocity of a fluid in the wellbore, (iv) a change in temperature, (v) a change in pressure, and (vi) eccentering of the tool within the wellbore.

23. A downhole tool for acquiring acoustic waves traversing a wellbore casing comprising:

(a) a first plurality of transducers housed on pads attached to extendable arms, said first plurality of transducers comprising a magnet and a coil mounted on the too configured to generate acoustic vibrations into the wellbore casing wherein said first plurality of transducers are configured to magnetically couple to said casing; and (b) a second plurality of transducers housed on pads attached to extendable arms wherein said second plurality transducers magnetically couple to said casing, said second plurality of transducers for acquiring said acoustic vibrations generated into the wellbore casing.

* * * * *